US006625932B1

(12) United States Patent
Littlefield

(10) Patent No.: US 6,625,932 B1
(45) Date of Patent: Sep. 30, 2003

(54) VARIABLE RISE VERTICALLY RETRACTABLE ARENA SEATING ASSEMBLY

(76) Inventor: Dexter Littlefield, P.O. Box 252, Wells Rd., North Berwick, ME (US) 03906

( * ) Notice: Subject to any disclaimer, the term of this patent is extended or adjusted under 35 U.S.C. 154(b) by 0 days.

(21) Appl. No.: 09/261,910

(22) Filed: Mar. 3, 1999

Related U.S. Application Data

(60) Provisional application No. 60/076,650, filed on Mar. 3, 1998.

(51) Int. Cl.[7] ..... E04H 3/12
(52) U.S. Cl. ..... 52/10; 52/7
(58) Field of Search ..... 52/6–10

(56) References Cited

U.S. PATENT DOCUMENTS

| | | | | | |
|---|---|---|---|---|---|
| 3,748,798 | A | * | 7/1973 | Mackintosh | 52/10 |
| 3,869,835 | A | * | 3/1975 | Mackintosh | 52/9 |
| 4,633,625 | A | * | 1/1987 | Dieban et al. | 52/30 |
| 4,854,092 | A | * | 8/1989 | Chatenay Epouse | 52/10 |
| 4,934,113 | A | | 6/1990 | Hall et al. | |
| 5,228,246 | A | | 7/1993 | Suzuki et al. | |
| 5,277,001 | A | | 1/1994 | Bryant | |
| 5,379,556 | A | | 1/1995 | MacIntyre | |
| 5,459,964 | A | | 10/1995 | Doublet | |
| 5,517,789 | A | | 5/1996 | Sugiyama | |
| 5,660,000 | A | * | 8/1997 | MacIntyre | 52/9 |
| 5,913,776 | A | * | 6/1999 | Compangnone | 52/10 |

OTHER PUBLICATIONS

Interkal, "Telescoping Seating Systems", Internet, pp 1–6 (best available copy).

* cited by examiner

*Primary Examiner*—Carl D. Friedman
*Assistant Examiner*—Yvonne M. Horton
(74) *Attorney, Agent, or Firm*—Maine & Asmus

(57) ABSTRACT

The invention in the simplest form is a retractable variable rise arena seating apparatus and method. It employs gravity displacement to facilitate adjusting and setting the various platforms, and uses a single drive motor assembly. The seating platforms can use any type of chair design, and is not limited to narrow profile designs. The seating system can be easily employed with minimum labor and time consumption for multi-purpose arenas.

12 Claims, 9 Drawing Sheets

VARIABLE RISE VERTICALLY RETRACTABLE ARENA SEATING ASSEMBLY

CROSS REFERENCE TO RELATED APPLICATIONS

This application claims priority under 35 U.S.C. §119(e) from a U.S. Provisional Patent Application Ser. No. 60/076,650 filed on Mar. 3, 1998, which is incorporated herein by reference for all purposes.

BACKGROUND OF THE INVENTION

1. Field of the Invention

The present invention relates to spectator seating systems and in particular to those systems that can be reconfigured for viewing events in multi-purpose facilities. More particularly, the present invention relates to a portable arena system with a variable rise vertically retractable platform assembly.

2. Background Art

Most leisure facilities today such as arenas and auditoriums are designed to accommodate multiple tenants to maximize revenue potential. It is not unusual for a facility to have a sporting event in the evening, a trade show the next morning and a concert later that same night.

The requirement to accommodate multiple tenants creates numerous problems for the movable seating assemblies located in the exhibition areas between the fixed seating and the event floor. Different events require different focal points and varying seating requirements. Riser heights on seating platforms must be able to change to provide optimum sight lines. The size of event floors, like basketball and hockey, are subject to change at each individual event. The first row of the seating assemblies sometimes might have to be elevated above the dasher to allow additional seating assemblies to be placed in front to make the seating continuous to the smaller event floor.

With two events scheduled in the same day, conversion time becomes critical. The seating equipment must be designed to minimize set-up time and labor costs. Also, the seating in the front area of the facility is closest to the event and demands the highest ticket price. The seating systems must be designed with integral chairs that are equal to or better than the chair used in the fixed seating to justify the higher seating price.

Attempts have been made to solve these problems with telescopic seating. One such method is described in U.S. Pat. No. 5,517,789 ('789). According to this patent, a plurality of telescopic movable rows supported by a wheeled wagon on each end are expanded outwardly one after another from their stored position. A number of side-by-side seats stored horizontal on the rows are raised up creating a spectator-seating system. To assure that each spectator sitting on his seat has optimum sight lines for viewing an event, each column supported by a wheeled wagon is provided a floor height adjusting mechanism.

The mechanism of the '789 patent is constructed of threaded shafts, pulleys, belts, sprockets, chains and a motor. However, this design has several problems. The floor height adjusting mechanism, coupled with the wheeled wagon, has many moving parts and makes this system expensive. It is also difficult to maintain alignment both vertically and horizontally with adjacent platforms. And, because the system is telescopic, the rows of seats must fold down for storage, requiring a chair with a very narrow profile. Thus, the higher priced front seats are typically not as comfortable as the wider fixed seats.

U.S. Pat. No. 5,277,001 uses two sets of telescopic platforms with each set having a different pitch to change the angle of view. The platforms are oppositely faced and attached to a central support structure. To change the angle of view, the attached chairs are folded down and the seating tiers are retracted inwardly, where upon they are placed on a dolly and rotated 180 degrees and then re-opened exposing the seating tiers with a new pitch. This design is very limited in providing solutions to previously stated problems. The system is expensive, and twice as many chairs and platforms are required. Conversion time to change from one event to the other is very labor intensive and time consuming, and the chairs must fold down for storage again resulting in a very narrow profile.

What is needed is a simple and easy-to-operate portable arena seating system. The device should allow variable rise in order to accommodate the arena and event requirements. The system must be deployable in a short time period with minimal labor. The seating on the portable system must allow for high quality comfortable seating. The system should have a low profile in the retracted state for storage and transport.

SUMMARY OF THE INVENTION

The present invention has been made in consideration of the aforementioned background. It is therefore an object of the present invention to provide a variable rise vertically retractable arena seating assembly that is entirely free from the problems inherent in the conventional prior art seating systems.

An object of the present invention is to provide a plurality of parallel stepped seating platforms attached to a vertically retractable support. Due to the low profile of the assembly when it is in its fully retracted state, it can be easily stored, The assembly can employ wheels and be wheeled from the storage cavities of the facility to the desired location.

In one embodiment, chairs of any design are rigidly attached to the platform and ready for use as soon as the assembly is positioned.

And a further object is to provide a vertically adjustable arena seating assembly wherein the plurality of parallel platforms are programmed, having at least four stepped risers of varying heights to reconfigure the facility for viewing multiple events. A non-elevated high rise profile for viewing events such as hockey. An elevated low rise profile for viewing events such as basketball. And, a non-elevated low rise profile to allow the assembly to be moved into storage cavities of the facility and a zero rise for concert events where some of the assemblies are converted to a stage Another object of the invention is to minimize conversion time and labor. Using the present invention eliminates the time required to fold the chairs down. It also eliminates the folding of platforms retracted horizontally to change from one event to the other.

An additional object of the invention is to provide an elevating means for the vertically adjustable arena seating assembly such that the lower support structure is interconnected to the upper support structure by a scissors mechanism. There is an outer scissors lever of the scissors mechanism, which is rotatably connected to the lower support structure on a first end and slidably connected to the upper support structure on the second end. There is also an inner scissors lever of the scissors mechanism, which is rotatably connected to the upper support structure on a first end and slidably connected to the lower support structure on a second end. An upper support adjusting means for vertically adjusting the upper support structure is provided, wherein the upper support adjusting means engages the second end of the inner scissors to adjust the upper support structure.

Yet an additional object of the inventions is a vertically adjustable arena seating assembly further comprising an automatic lock to hold the upper support structure at a desired height wherein the automatic lock is positioned by hydraulic means.

Yet another object of the invention is to allow a single motor drive system to control the operation of the elevating means, where the means of operating is a motor connected to a hydraulic pump that engages a hydraulic ram assembly.

And, an object is an elevating means that not only provides the potential energy used to drive the floor height adjusting mechanism, but it also allows the first row of the assembly to be elevated above the floor to allow the placement of additional seating assemblies in front of the elevated unit to make the seating continuous to a smaller event floor. Yet another object is a vertically adjustable arena seating assembly further comprising a means of simultaneously unlocking the plurality of platforms to change the riser heights of the assembly.

Another object of the invention is to provide a floor height adjusting mechanism that does not require a powered mechanical device on every platform to change the riser heights. The present invention provides for a floor height adjusting mechanism that uses a combination of the force of gravity and the elevating means of the upper support structure to move the elements of the floor height adjusting mechanism up and down when the center of gravity of the floor height adjusting mechanism is changed. The elements of the floor height adjusting mechanism comprise an inner frame, an outer telescopic frame assembly and a program support with locking plates. The inner frame is solidly connected at the top to the plurality of platform and slidably attached at the bottom to the outer telescopic frame. It uses a program support that is housed inside the inner frame to provide a long position and the base of the outer telescopic frame for a short position. The outer frame is a telescopic column assembly with the inner column solidly connected at the base to the upper support structure and the outer telescopic column slidably engaged with the inner support frame at the top.

And another object is a vertically adjustable arena seating assembly further comprising a plurality of aisle steps on each of the plurality of platforms. The aisle steps create a uniform step from one platform to the next when the platform heights exceed building codes.

An object includes a method of adjusting the plurality of platforms from a fully retracted state to a platform assembly with a non elevated first row, with all remaining rows having a high rise. Such a method comprises the steps of elevating the upper support structure and lifting the plurality of parallel platforms with all the inner frames of the adjusting mechanisms in their short position. In the short position the locking plates can simultaneously engage the locking slots at the tops of the program supports that have extended by the force of gravity to the base of the inner frame supports providing a long position for the inner frame. As the upper support structure is retracted, the program supports move down and the bases sequentially make contact with the lower support structure from top to bottom. When contact is made, the inner frame becomes static in a high rise position. As the outer frame continues to move down the base of the inner frame, it makes contact with top of the outer telescopic frame, forcing the outer telescopic frame to expand upward to support the high rise position of the inner frame.

Yet another object is a method of adjusting the plurality of platforms from a non elevated high rise position to a position having an elevated first row with the remaining rows having a low rise. Such a method comprises the steps of elevating the upper support structure allowing the inner frame of the floor height adjusting mechanism to sequentially move down from bottom to top and come to a static position at the base of the outer telescopic frame leaving the plurality of platforms in an elevated low rise position.

Another object is a method of adjusting the plurality of platforms from an elevated low rise position to a vertically retracted low-rise position for storage. This method comprises the steps of unlocking the program supports and lowering the upper support structure whereby when the program supports make contact with the lower support structure they telescope inside the inner support frames leaving the plurality of platforms in a low rise and fully retracted position.

An additional object is a method for changing the plurality of platforms to a zero rise to convert the assembly to a stage for concert events. This method requires special adjustable program supports with additional locking slots and manual positioning of the locking plates.

To change the plurality of platforms from the fully retracted position, the plurality of platforms are lifted by the elevating means, allowing the program supports to extend down by the force of gravity, positioning the top such that it can be locked or unlocked from the inner support frame. On the top platform the locking plate remains in the unlocked position and the program support is manually adjusted to a length less than the length of its own inner frame. On the platform second from the top, the locking plate is locked and the program support is manually adjusted to have a length that will provide the same elevation as the top platform. On the platform third from the top the locking plate is locked and the program support is manually adjusted to have a length that will provide the same elevation as the top platform. The first row is elevated to a height equal to the other three by a scissors mechanism driven by a slave hydraulic ram and held in place by a manually positioned swing down program support. As the upper support structure is lowered, the bases of the program supports make contact with the lower support structure adjusting the platforms with equal heights.

An object includes a variable rise vertically retractable arena seating assembly, comprising an upper support structure interconnected to a lower support structure, wherein the upper support structure is oriented over the lower support structure. There is a means for vertically elevating the upper support structure from a retracted- position to an elevated position over the lower support structure imparting potential energy in the upper support structure. A plurality of platforms are on the upper support structure, and there is a floor height adjusting mechanism having a means of adjusting a riser height of the platforms using the potential energy from the upper support structure.

Additionally, an object is a variable rise vertically retractable arena seating assembly wherein the lower support structure is inter-connected to the upper support structure by a scissors mechanism, wherein an outer scissors lever of the scissors mechanism is rotatably connected to the lower support structure on a first end and slidably connected to the upper support structure on a second end. An inner scissors lever of the scissors mechanism is rotatably connected to the upper support structure on a first end and slidably connected to the lower support structure on a second end. Finally, there is an upper support adjusting means for vertically adjusting the upper support structure, wherein the upper support adjusting means engages the second end of the inner scissors to engage the scissors mechanism and vertically adjust the upper support structure.

An object includes a variable rise vertically retractable arena seating assembly wherein the upper support adjusting means is a motor connected to a hydraulic pump that engages a hydraulic ram assembly. And, a plurality of wheels attached to the lower support structure.

Another object is a variable rise vertically retractable arena seating assembly, further comprising a plurality of seats attached to each of the plurality of platforms, wherein the seats continuously remain in an active position.

Yet another object is a variable rise vertically retractable arena seating assembly, further comprising a means for locking the upper support structure at a specific height.

Another object is a single point means for simultaneously positioning the program support locking plates.

An object is a method of vertically adjusting platforms for arena seating, comprising the steps of raising an upper support structure, thereby imparting potential energy to the support structure, adjusting the platforms, wherein a program support mechanism establishes a height of each platform, locking the program support mechanism at that height, and lowering the upper support structure, wherein the program support mechanism contacts the lower support structure, thereby raising the platform upwards relative to the upper support structure.

An object is a method of vertically adjusting platforms for arena seating, further comprising the step of raising the upper support structure to position the platforms at a elevated low rise position.

A further object includes a method of vertically adjusting platforms for arena seating for a non elevated first row with all remaining rows having a high rise position, comprising the steps of elevating the upper support structure, locking simultaneously the program support mechanism, lowering the upper support structure, and allowing the base of the program support mechanism to sequentially make contact with the lower support structure causing the inner support frame to become static in a high rise position.

A final object is a method of elevating the upper support structure, adjusting elements of the floor height adjusting mechanism with equal heights, activating a first platform lifting device, deploying a first row program supports, lowering said upper support structure, and leaving the plurality of platforms with a zero rise position.

Other objects, methods, features and advantages are apparent from description in conjunction with the accompanying drawings.

DESCRIPTION OF THE PREFERRED EMBODIMENT

The present invention is a vertically retractable bleacher assembly that allows a plurality of platforms to be vertically positioned for a given event in an arena or stadium. The platforms support various seating members and the entire assembly is moveable horizontally on wheels. When the assembly is in a low position, it can be easily stored.

In FIGS. 1 through 4 the plurality of platforms A, B, C, and D on the seating assemblies are reconfigured with varying riser heights. The mechanisms that allow the plurality of platforms to be reconfigured are shown in FIGS. 5–8

Figure 1:
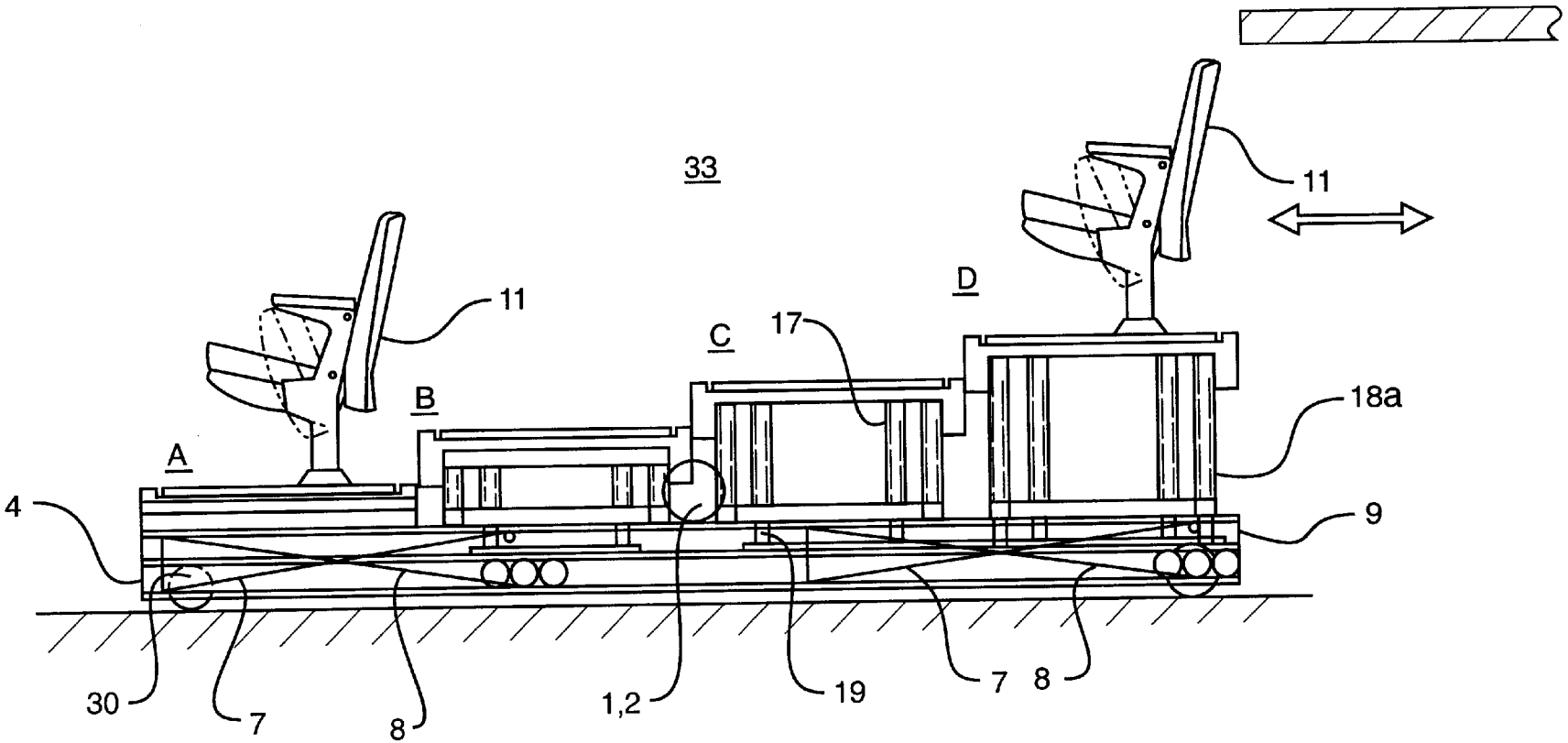
FIG. 1 is an enlarged side view of the seating assembly in its fully retracted low rise position.

The variants of the invention illustrated in FIGS. 1–5 are explained beginning with the invention in its fully retracted state of FIG. 1 wherein the seating assembly 33 is in its fully retracted state, with a plurality of platforms A, B, C, and D in their lowest position. In the retracted state the entire seating assembly can be stored and transported occupying minimal space.

The fully retracted seating assembly moves horizontally on a set of wheels 30, and is wheeled to the appropriate location either manually or by a motorized means. Various casters and wheels 30 are possible to support and move the assembly, although the assembly can also be fixed in a location. The lower support structure 4 provides structural rigidity to the assembly. The present invention accommodates any size chair 11.

Figure 2:
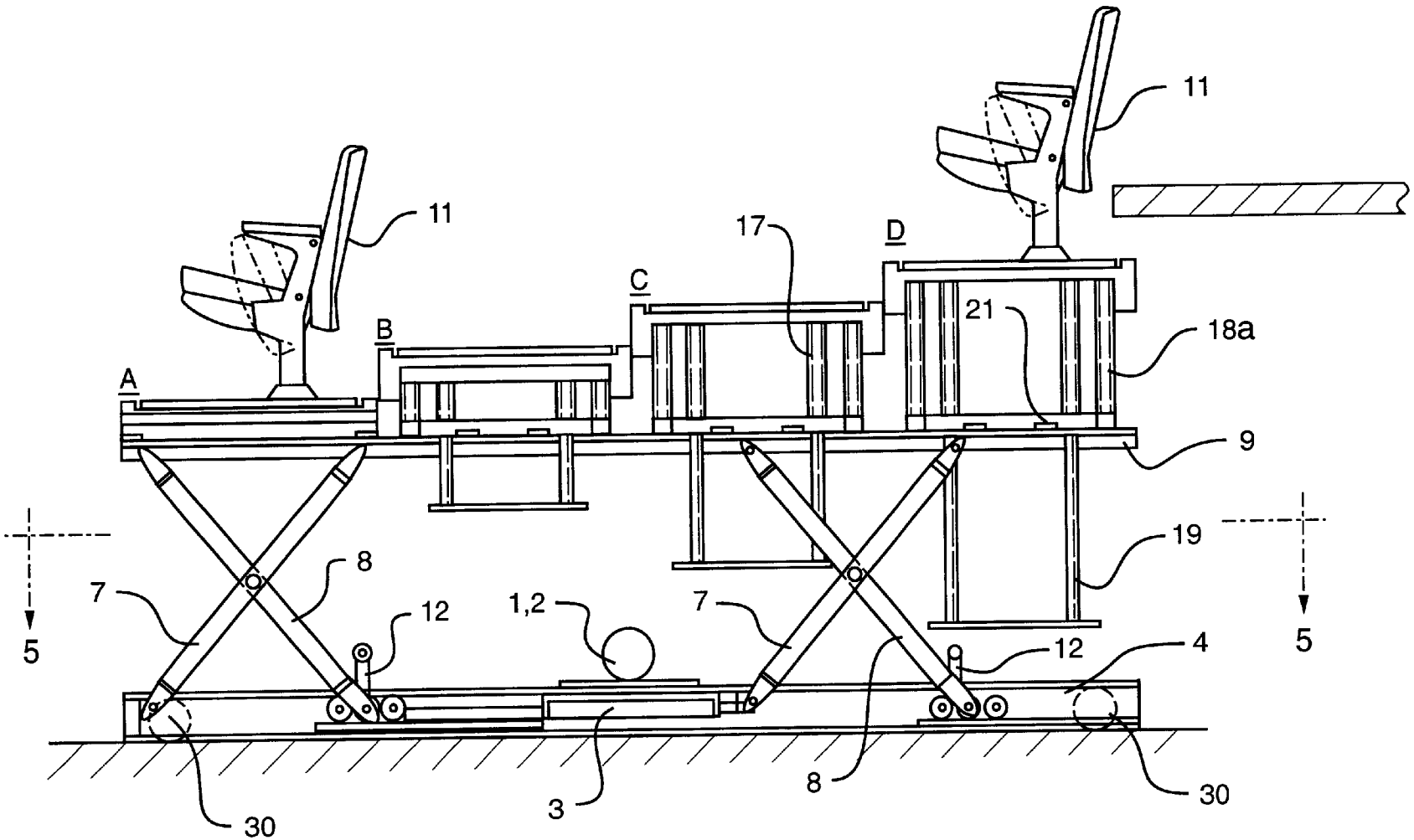
FIG. 2 is an enlarged side view of the seating assemblies shown elevated.

FIG. 2 shows by way of side view the operative state of the plurality of platforms A, B, C, and D whereby platform A is shown elevated above the lower support structure 4 and platforms B, C, and D are programmed with a low rise. This variant of the invention is accomplished by elevating the upper support structure 9 utilizing the scissors mechanism, consisting of outer scissors lever 7 and inner scissors lever 8 shown in FIGS. 6*a* and 6*b*.

Figure 3:
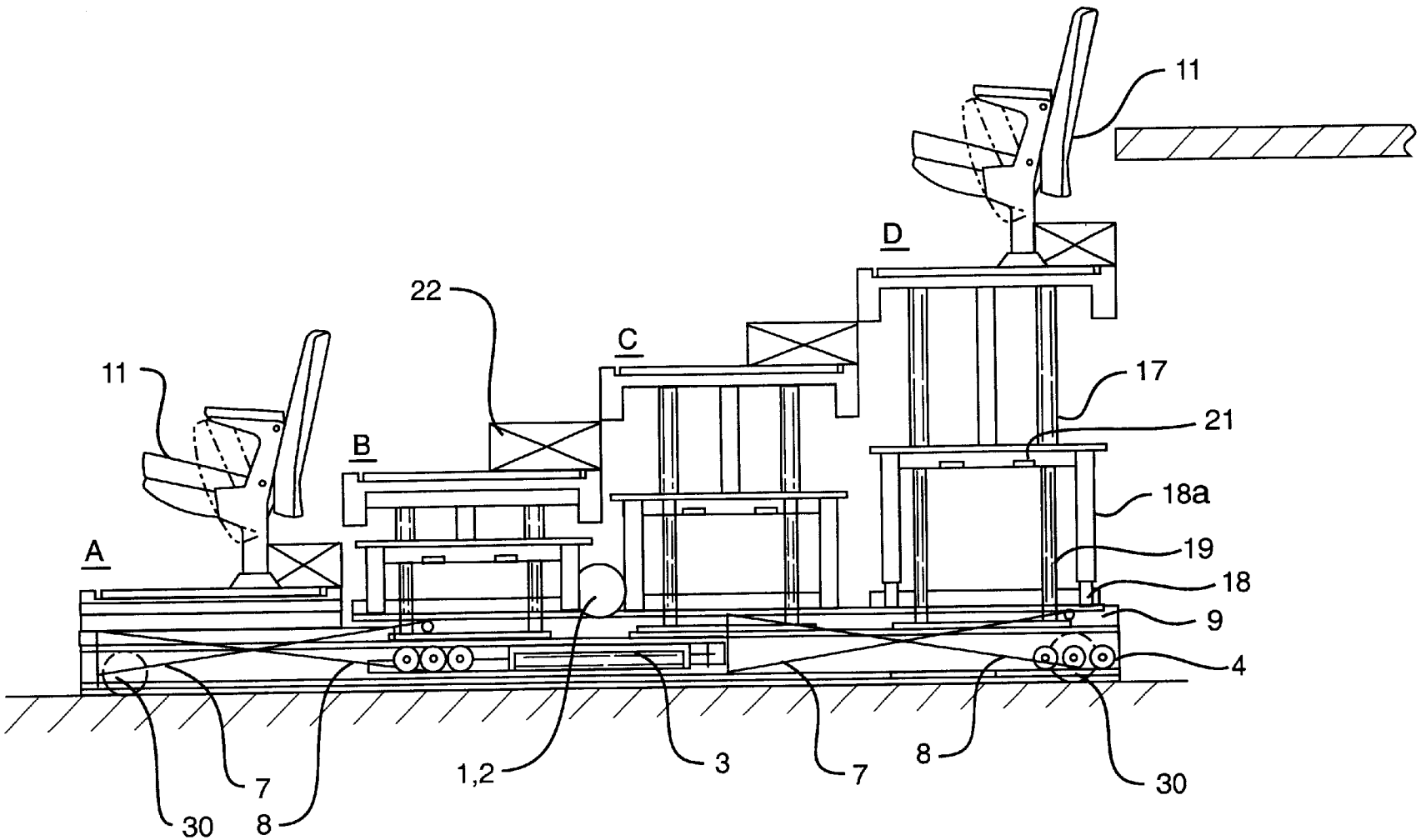
FIG. 3 is an enlarged side view of the seating assembly shown non -elevated with a high rise.

FIG. 3 shows by way of side view the operative state of the plurality of platforms A, B, C, and D whereby platform A is shown non-elevated above the lower support structure 4 and platforms B, C, and D are programmed with a high rise position. This is accomplished by elevating the upper support structure 9 and lifting the plurality of platforms A, B, C, and D with the inner frames 17 of the floor height adjusting mechanisms in their short position as shown in FIG. 2. In the short position the spring loaded locking plates 21 engage the locking slots 19*a* at the tops of the program supports 19 as they extend by the force of gravity to the base of the inner frame 17 providing a long position for the inner frame 17. A plurality of aisle steps 22 on each of the platforms creates a uniform step from one platform to the next when the platform heights exceed building codes.

Figure 7:
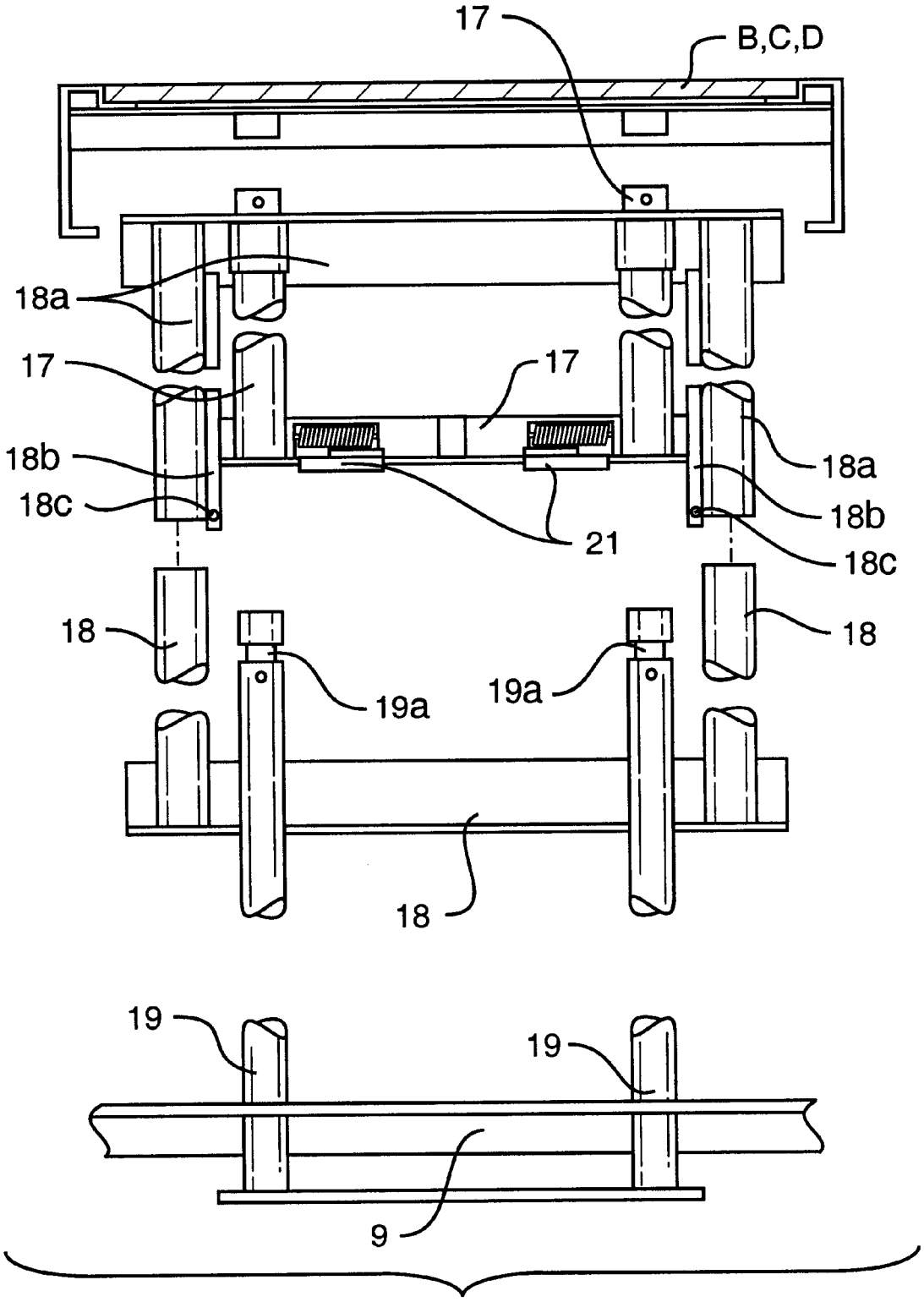
FIG. 7 is an exploded view of the elements of the floor height adjusting mechanism.

This aspect is more clearly illustrated in FIG. 7. When the upper support structure 9 is retracted by reversing the elevating means, the program supports 19 moves down and the bases sequentially make contact with the lower support structure 4 from top to bottom. When contact is made, the inner frame 17 becomes static in a high rise position. The outer frame assembly continues to move down the base of the inner frame 17 and makes contact with top of the outer telescopic frame 18*a* forcing the outer telescopic frame 18*a* to expand upward to support the high rise position of the inner frame, leaving the invention in a non-elevated high rise position. This variant of the invention comprises the steps of releasing the mechanism holding the locking plates 21 in the unlocked position by rotating pinion gear 23.

Figure 4:
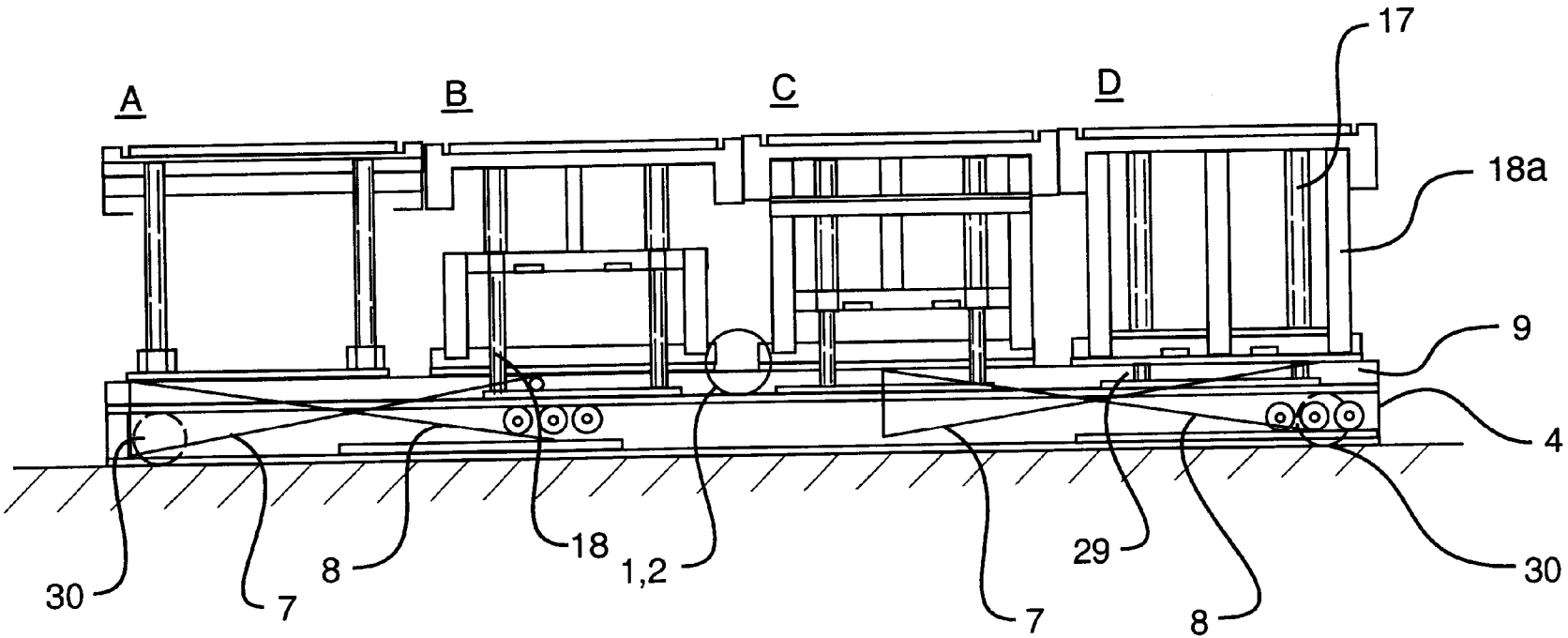
FIG. 4 is an elevation of the assembly showing the seating rows programmed such that all rows are the same elevation converting the assembly from all tiered platforms to a level elevated area that can be used as a stage.

FIG. 4 shows by way of side view the operative state of the plurality of platforms A, B, C, and D whereby platforms A, B, C, and D are programmed with the same elevation. This embodiment of the invention comprises the steps of lifting the plurality of platforms in their short position by the elevating means, allowing the adjustable program supports 29 to extend down by the force of gravity, and positioning the locking slot 19*a* such that it can be manually locked or unlocked from the inner frame 17.

On platform D the locking plate 21 remains in the unlocked position and the adjustable program support 29 is adjusted to a length less than the length of the inner frame 17. On platform C, the locking plate 21 is locked and the adjustable program support 29 is adjusted to have a length that will provide the same elevation as platform D. On the platform B the locking plate 21 is locked and the adjustable program support 29 is adjusted to have a length that will provide the same elevation as platform D. The first row A is elevated to a height equal to the other three platforms by a scissors mechanism driven by a slave hydraulic ram and held in place by a manually positioned swing down program support. As the upper support structure 4 is lowered, the bases of the adjustable program supports 29 make contact with the lower support structure 4 adjusting the platforms with equal heights.

Another embodiment, not shown, is to create oversize boxes or press boxes. The plurality of platforms are adjusted using the adjustable program support 29, wherein A is programmed to be at the same level as B and C is programmed to be at the same level as D doubling the width of the programmed rows. Any number of platforms can be doubled to allow for freestanding oversized chairs and press tables.

The description to return the invention back to its fully retracted position comprises the steps of elevating the upper support structure 9 allowing the inner frame 17 to seek a short position. With all the inner frames 17 now in their short position, the program support 19 can be simultaneously unlocked from the inner frames 17, wherein when pinion gear 23 is rotated, the contact mechanism attached to the gear racks 24*a* and 24*b* make contact with locking plates 21 unlocking the program support 19 from the inner frame 17. As the upper support structure 9 is lowered, the program supports 19 telescopes inside the inner frame 17 leaving the plurality of platforms A, B, C, and D with a low rise and fully retracted position.

Figure 5:
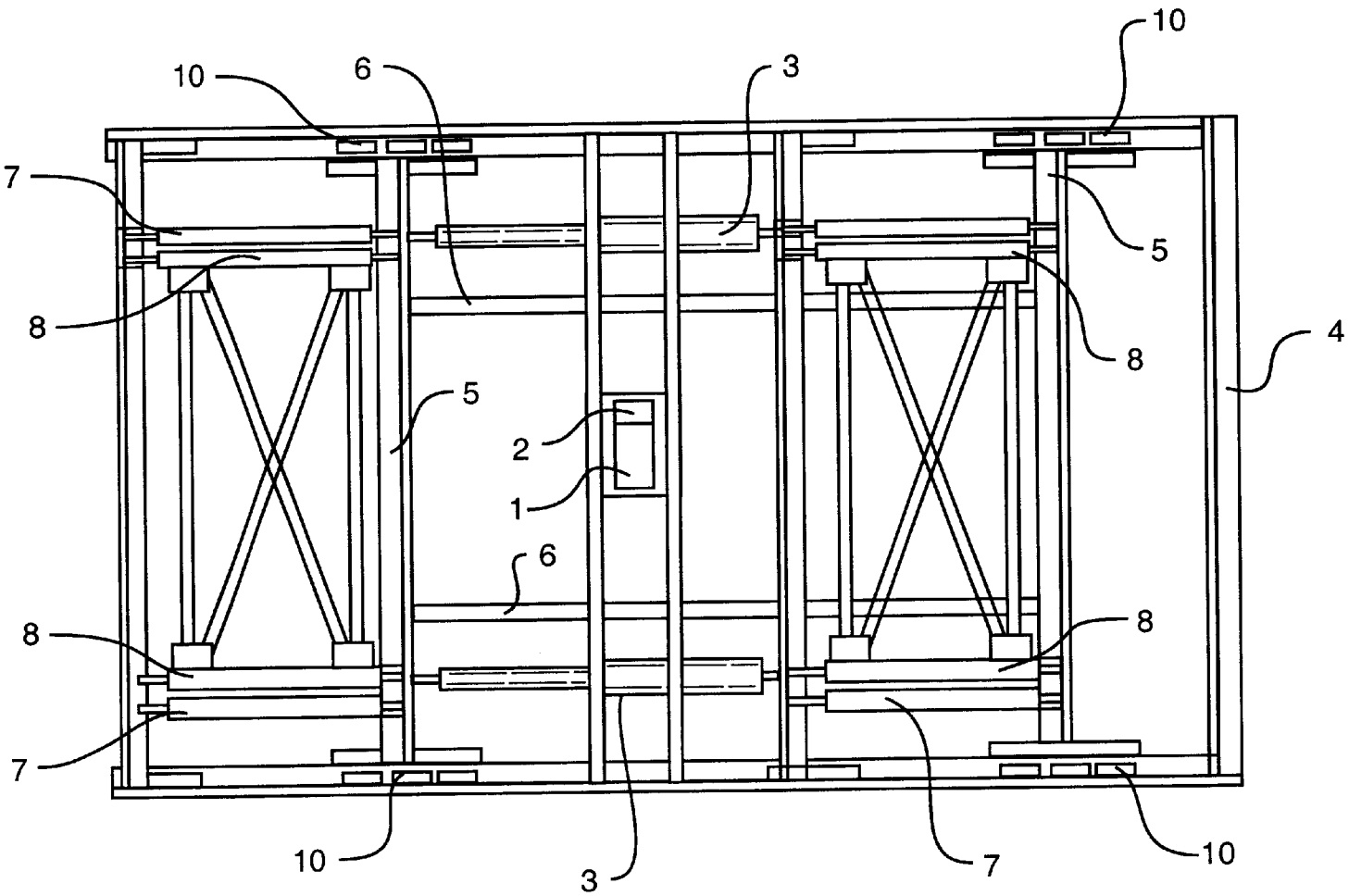
FIG. 5 is a plan (top) view of the assembly with the seating rows removed showing the supporting framework and related hardware.

FIG. 5 is a plan (top) view of the assembly with platforms A, B, C, and D removed to show the drive mechanism of the assembly used to elevate the scissors mechanism and support structure, wherein the drive mechanism consists of a motor 1 and hydraulic pump 2. The motor 1 and hydraulic pump 2 are connected to two hydraulic rams 3, which are attached to a lower support structure 4. The hydraulic rams 3 are attached to the front cross bar 5 that in turn is attached to tie bars 6. When the hydraulic rams 3 are extended, tie bars 6 pulls cross bar 5 at the rear of the assembly. This allows the scissors mechanism, outer lever 7 and inner lever 8, to move in unison at all four locations of the assembly.

Figure 6A:
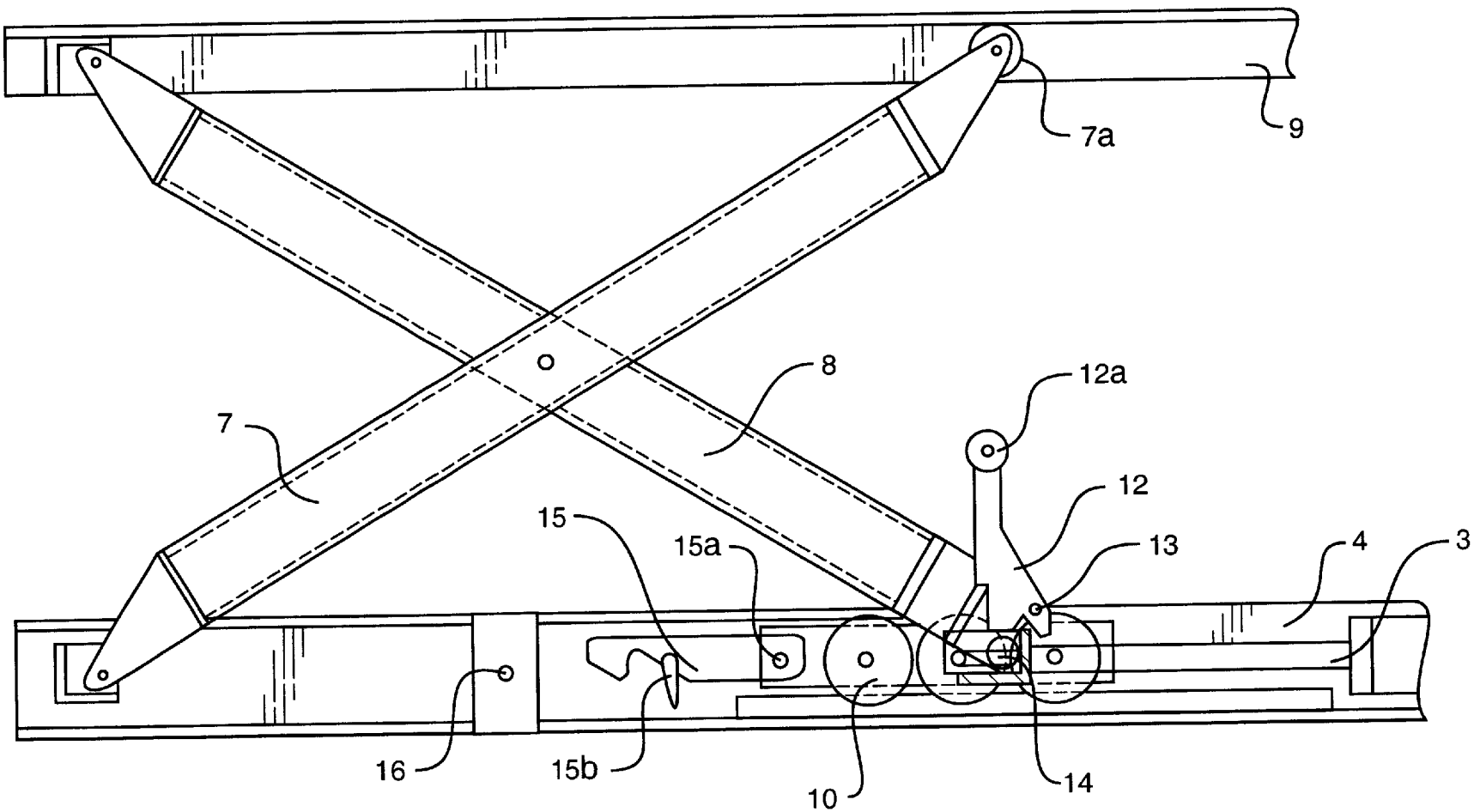
FIG. 6*a* is a detail view showing the scissors mechanism elevated.
Figure 6B:
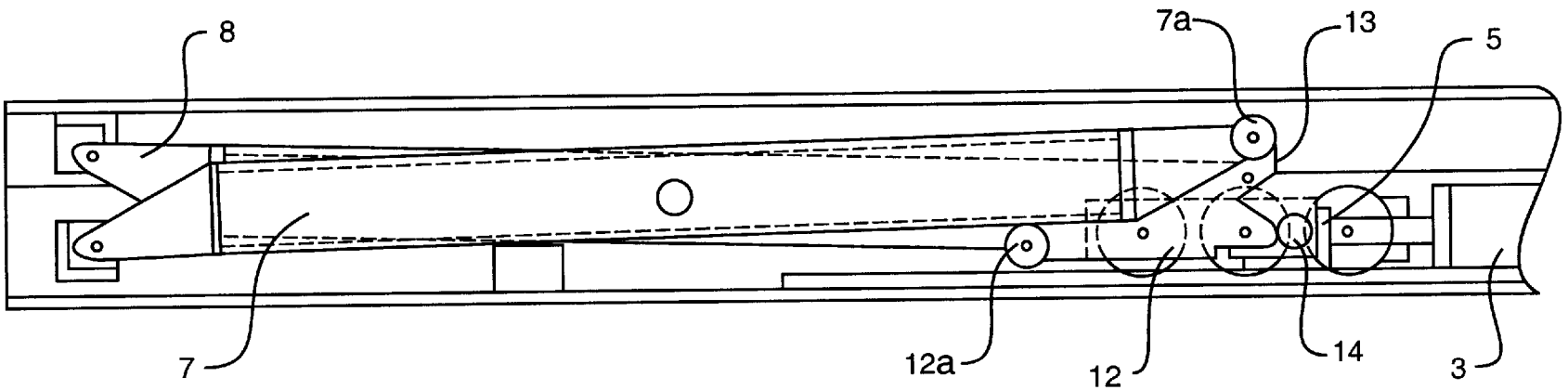
FIG. 6*b* is a detail view showing the scissors mechanism retracted.

The scissors mechanism levers 7 and 8 move from the lowest position to the highest position as shown in FIG. 6*a* and FIG. 6*b*. The inner scissors lever 8 is rotatably attached to the upper support structure 9, and the other end is connected to a lower wheel and track assembly 10. Outer scissors lever 7 is rotatably attached on one end to lower support structure 4, and the other end is connected to an upper wheel 7*a* that resides on the upper support structure 9.

The trig arm 12 is used to overcome the vertical forces on the scissors mechanism when it is in its lowest position. Trig arm 12 lifting motion begins when cross bar 5 is pushed or pulled by the extension of the hydraulic rams 3 as shown in FIG. 5. The trig arm 12 is connected to the inner lever 8 of the scissors mechanism by a connection pin 13. As the cross bar 5 moves, the inner lever 8 slides in a captivating slot on the cross bar 5 carrying the trig arm 12 with it, until its movement is restricted by stop pin 14 causing the trig arm 12 to pivot on the connection pin 13. As the trig arm 12 rotates, the roller 12*a* on the trig arm travels along the underside of the outer lever 7 starting the scissors assembly to rise.

When the elevation of upper support structure 9 is achieved, an automatic lock 15 is employed to hold the multitude of platforms in the position shown in FIG. 2. The automatic lock 15 shown in FIGS. 6*a* and 6*b* is attached to the lower wheel and track assembly 10. When the lower wheel and track assembly 10 is moved by the hydraulic rams 3, the sloping front of the lock 15 comes in contact with a stationary locking pin 16 attached to the lower support structure 4. As the forward motion continues, the locking plate 15 pivots on pin 15*a* and the captivating slot on the locking plate drops over the stationary locking pin 16. To release the automatic lock 15, the hydraulic rams 3 push the wheel assembly 10 forward to allow the hinged captivating slot channel 15*b* to ride up over stationary pin 16. As the wheel assembly 10 is moved back by the hydraulic rams 3, the hinged captivating slot channel 15*b* makes contact with the front of the locking plate 15 closing off the captivating slot thereby releasing the locking plate 15 from the stationary pin 16.

The apparatus that is used to adjust the riser heights of the plurality of platforms is shown in FIG. 7. The mechanism uses a combination of the force of gravity and the elevating means of the upper support structure to program the plurality of platforms B, C and D with varying riser heights when the center of gravity of the floor height mechanism is changed. The floor height adjusting mechanism comprises an inner frame 17, an outer telescopic frame assembly having an inner column 18 and a telescopic outer column 18*a* and a program support 19. The inner frame 17 is solidly connected at the top to the seating platforms B, C and D and is slidably engaged to a track 18*b* mounted to the outer telescopic frame 18*a*. It uses the program support 19, which is housed inside the inner frame 17, to provide a long position and the stop pin 18*c* at the base of the outer telescopic frame for the short position. The outer telescopic frame assembly with the inner column 18 is solidly connected at the base to the upper support structure 9 and the outer telescopic column 18*a* is slidably engaged with the inner support frame 17 at the top and bottom.

The locking plate 21, not shown in detail, is captivated in a slotted hole provided in the base of the inner frame 17. The locking plate 21 is spring loaded and automatically engages the locking slot 19*a* at the top of the program support 19 when the program support 19 deploys from the inner frame 17, providing a long position for the inner frame 17.

Figure 8:
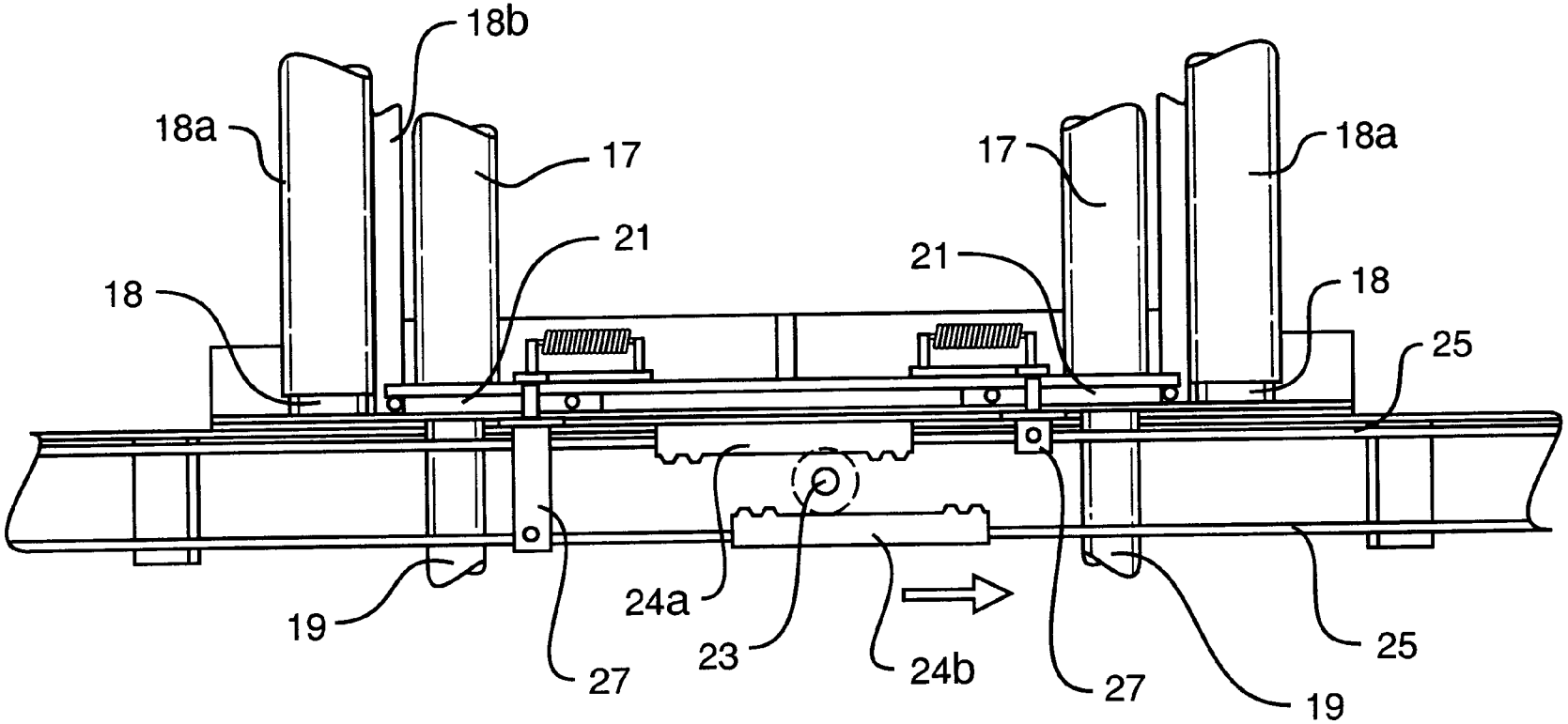
FIG. 8 is a detail view showing the unlocking mechanism for the locking plates.

FIG. 8 shows the mechanism that provides a means for simultaneously unlocking the locking plates 21 from the program supports 19. The mechanism is a rack and pinion device wherein when pinion gear 23 is rotated, the upper gear rack 24*a* and lower gear rack 24*b* move horizontally in opposite directions. Attached to the gear racks 24*a*, 24*b* are rods 25 provided with a contact mechanism 27 for unlocking the program support 19.

The foregoing description of the preferred embodiment of the invention has been presented for the purpose of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

The invention is susceptible of many variations, all within the scope of the claims. The preferred embodiment described here and illustrated in the figures should not be construed as in any way limiting.

No warranty is expressed or implied as to the actual degree of safety, security or support of any particular specimen of the invention in whole or in part, due to differences in actual production designs, materials and use of the products of the invention.

What is claimed is:

1. A portable variable rise vertically retractable arena seating assembly having modifiable platform elevations for viewing events in multi-purpose facilities, comprising:

a plurality of parallel stepped adjustable platforms wherein said adjustable platforms are supported on both ends to a telescopic floor height adjusting mechanism, wherein said telescopic floor height adjusting mechanism comprises an arrangement of telescopic components, a locking means and a scissors mechanism for providing height adjustment of each of said plurality of parallel stepped platforms;

a plurality of seats affixed in an active position to said parallel stepped adjustable platforms;

a framework for supporting said telescopic floor height adjusting mechanism comprising an upper support structure oriented over a lower support and a scissors mechanism whose lever arms are interconnected to said upper and lower support structure, wherein said scissors mechanism comprises an outer scissors lever arm connected to said lower support structure on a first end and connected to an upper support structure on a second end and an inner scissors lever arm connected to said upper support structure on a first end and connected to said lower support structure on a second end;

a means for raising and lowering said telescopic floor height adjusting mechanism and said scissors mechanism with a force directed parallel to the floor; and a plurality of floor engaging wheels affixed to said arena seating assembly for moving said arena seating assembly from a stored position to a use positions.

2. A portable variable rise vertically retractable arena seating assembly according to claim 1 wherein said outer scissors lever arm is rotatably connected to said lower support structure on said first end and slidably connected to said upper support structure on said second end and said inner scissors lever arm is rotatably connected to said upper support structure on said first end and slidably connected to said lower support structure on said second end.

3. A portable variable rise vertically retractable arena seating assembly according to claim 1, wherein said means for elevating is an electric motor connected to a hydraulic pump that engages a hydraulic ram assembly, wherein said electric motor, hydraulic pump and hydraulic ram are mounted such that forces exerted by said hydraulic ram assembly are transformed into angular movement of said scissors mechanism.

4. A portable variable rise vertically retractable arena seating assembly according to claim 1, wherein said floor height adjusting mechanism comprises an inner frame, an outer telescopic frame assembly, a program support, and a locking mechanism wherein;

(a) said inner frame is connected at a first end to said plurality of platforms and slidably attached at a second end to said outer telescopic frame assembly wherein said program support is housed inside said inner frame engages said locking mechanism to provide a long position and a stop pin at a base of said outer telescopic frame assembly for a short position and (b) said outer telescopic frame assembly comprises an inner column, an outer telescopic column wherein said inner column is connected at a first end to said upper support structure and said outer telescopic column is slidably engaged with said inner frame.

5. A portable variable rise vertically retractable arena seating assembly according to claim 4, wherein said locking mechanism of said floor height adjusting mechanism comprises a rack and pinion arrangement whereby an upper rack is oriented over a lower rack wherein rotation of a pinion gear moves said upper rack and lower rack in opposing directions with a means for unlocking said program support.

6. A portable variable rise vertically retracted arena seating assembly according to claim 1 wherein each of said plurality of platforms have an independent means to provide equal heights in relationship to one another wherein a first platform elevation is modifiable from an independent means and remaining platform elevations are modifiable using said floor height adjusting mechanism wherein an adjustable program support controls individual positioning of each of said remaining platforms to maintain a level and parallel relationship between said plurality platforms and a floor.

7. A portable variable rise vertically retractable arena seating assembly according to claim 1 wherein a plurality of spectator seats are arranged on said plurality of platforms in a side by side relationship wherein said seats remain in an active upright position when said arena seating assembly is moved transversely from said stored position to said use position.

8. A portable variable rise vertically retractable arena seating assembly according to claim 1, wherein two or more of said plurality of parallel stepped platforms are adjusted to a same elevation to create an extended platform.

9. A portable variable rise vertically retractable arena seating assembly according to claim 1, further comprising a plurality of adjustable aisle steps integrally mounted to each of said plurality of platforms.

10. A method of vertically adjusting a plurality of parallel stepped platforms for arena seating, comprising the steps of:

moving said platforms from a stored position to a use position elevating an upper support structure and lifting said plurality of parallel stepped platforms wherein an inner frame and outer telescopic frame assembly of a floor height adjusting mechanism for each said platform are in a short position; adjusting said floor height adjusting mechanism, wherein a program support mechanism is engaged to provide a long position of said inner frame; and adjusting said upper support structure, wherein components of said floor height adjusting mechanism move in opposing directions relative to movement of said upper support structure providing the plurality of parallel stepped platforms with a variable rise.

11. A method of vertically adjusting a plurality of parallel stepped platforms for arena seating according to claim 10 to provide the plurality of platforms with equal heights in relationship to one another, comprising the steps of elevating said upper support structure; manually adjusting the program supports of said floor height adjusting mechanism with equal heights, activating a first platform lifting device, deploying a first row program supports, lowering said upper support structure, and leaving said plurality of platforms with a zero rise position.

12. A method of vertically adjusting a plurality of parallel stepped platforms for arena seating according to claim 10, for a non elevated first row with all remaining rows having a high rise position, comprising the steps of:

elevating said upper support structure;

locking simultaneously said program support mechanism to said inner frame;

lowering said upper support structure; and allowing the base of said program support mechanism to sequentially make contact with said lower support structure causing said inner support frame to become static in said high rise position.

* * * * *